US008179344B2

(12) United States Patent
Hsieh et al.

(10) Patent No.: US 8,179,344 B2
(45) Date of Patent: May 15, 2012

(54) LIQUID CRYSTAL DISPLAY PANEL, DRIVING METHOD AND LIQUID CRYSTAL DISPLAY

(75) Inventors: Ming-Feng Hsieh, Tainan (TW); Chih-Yung Hsieh, Tainan (TW); I-Lin Ho, Tainan (TW); Chien-Hong Chen, Tainan (TW); Che-Ming Hsu, Tainan (TW)

(73) Assignee: Chimei Innolux Corporation, Miao-Li County (TW)

( * ) Notice: Subject to any disclaimer, the term of this patent is extended or adjusted under 35 U.S.C. 154(b) by 1028 days.

(21) Appl. No.: 11/824,248

(22) Filed: Jun. 29, 2007

(65) Prior Publication Data

US 2008/0018573 A1 Jan. 24, 2008

(30) Foreign Application Priority Data

Jun. 30, 2006 (TW) ..... 95123741 A

(51) Int. Cl.
*G09G 3/36* (2006.01)

(52) U.S. Cl. ..... 345/87; 345/204; 345/205; 345/214; 349/33; 349/39; 349/144

(58) Field of Classification Search ..... 345/87, 345/204, 205, 214; 359/33; 349/33, 39, 349/144

See application file for complete search history.

(56) References Cited

U.S. PATENT DOCUMENTS

| | | | | |
|---|---|---|---|---|
| 4,621,260 | A * | 11/1986 | Suzuki et al. | 345/92 |
| 5,173,791 | A * | 12/1992 | Strathman et al. | 349/48 |
| 5,285,302 | A * | 2/1994 | Wu | 349/43 |
| 5,686,932 | A * | 11/1997 | Tomita | 345/94 |
| 5,923,310 | A * | 7/1999 | Kim | 345/90 |
| 6,421,039 | B1 * | 7/2002 | Moon et al. | 345/100 |
| 6,864,871 | B1 * | 3/2005 | Okada et al. | 345/90 |
| 6,922,183 | B2 * | 7/2005 | Ting et al. | 345/87 |
| 7,391,402 | B2 * | 6/2008 | Lee | 345/96 |
| 7,518,687 | B2 * | 4/2009 | Chen et al. | 349/139 |
| 7,652,725 | B2 * | 1/2010 | Lee et al. | 349/38 |
| 2004/0164924 | A1 * | 8/2004 | Boger | 345/3.1 |
| 2005/0036091 | A1 * | 2/2005 | Song | 349/129 |
| 2005/0122441 | A1 * | 6/2005 | Shimoshikiryoh | 349/38 |
| 2005/0219186 | A1 * | 10/2005 | Kamada et al. | 345/90 |
| 2006/0256271 | A1 * | 11/2006 | Shimoshikiryo | 349/144 |
| 2006/0262237 | A1 * | 11/2006 | Chen et al. | 349/38 |

FOREIGN PATENT DOCUMENTS

| | | |
|---|---|---|
| JP | 2004-145266 | 5/2004 |
| JP | 2006-119539 | 5/2006 |

OTHER PUBLICATIONS

Japanese Patent Office, Office Action mailed Jan. 31, 2012 in Japanese application No. 2007-165319.

* cited by examiner

*Primary Examiner* — Grant Sitta
(74) *Attorney, Agent, or Firm* — Trop, Pruner & Hu, P.C.

(57) ABSTRACT

In one embodiment of the invention, a pixel unit has two sub-pixel regions each including a liquid crystal capacitor (LCC) and storage capacitor (SC). The capacitance ratio of the SC to LCC of the first sub-pixel differs from the capacitance ratio of the SC to LCC of the second sub-pixel.

17 Claims, 12 Drawing Sheets

LIQUID CRYSTAL DISPLAY PANEL, DRIVING METHOD AND LIQUID CRYSTAL DISPLAY

CROSS REFERENCE TO RELATED APPLICATION

This claims priority under 35 U.S.C. §119 of Taiwan Application No. 95123741, filed Jun. 30, 2006, which is hereby incorporated by reference.

TECHNICAL FIELD

The present invention relates to a display panel, a driving method, and a display device. More particularly, the present invention relates to a liquid crystal display (LCD) panel, a method for driving a liquid crystal display panel, and a liquid crystal display.

BACKGROUND

In a conventional multi-domain vertical alignment (MVA) LCD, protrusions or slits on a color filter substrate or a thin film transistor (TFT) array substrate make liquid crystal molecules arrange in multiple directions. This creates different alignment domains which allow the conventional MVA LCD to have a wide viewing angle. However, the transmittance of the MVA LCDs changes along with the variation of the wide viewing angle, which results in a variation of gray level. In other words, when the viewing angle varies, the brightness of the MVA LCD changes, which causes color shift.

FIG. 1 is a characteristic curve diagram of voltage to transmittance of a conventional MVA LCD. Referring to FIG. 1, the curve 11 to the curve 13 indicates the light transmittance observed when viewing the MVA liquid crystal display panel from the front. The curve 11 is a transmittance of red light, the curve 12 is a transmittance of green light, and the curve 13 is a transmittance of blue light. However, when viewing the MVA LCD panel from an oblique angle (e.g., 60 degrees), under the same working voltage the observed light transmittance changes and drifts from the curves 11, 12, and 13 to the curves 14, 15, and 16 respectively.

It can be seen that in regions of a higher gray level and a lower gray level, the light transmittance of the curve 11 is approximate to that of the curve 14, the light transmittance of the curve 12 is approximate to that of the curve 15, and the light transmittance of the curve 13 is approximate to that of the curve 16. However, in the middle gray level region, the light transmittances of the curves 11, 12, and 13 are significantly different from those of the corresponding curves 14, 15, and 16. In other words, the color shift phenomenon of the higher and lower gray levels is slight, and the color shift phenomenon of the middle gray level is severe.

In order to eliminate or reduce the color shift phenomenon, the conventional art divides one pixel unit into two regions of different light transmittances. The light transmittance of one region is relatively higher, thus displaying the color of a higher gray level, and the light transmittance of the other region is lower, thus displaying the color of a lower gray level. The color of the higher gray level and the color of the lower gray level are then mixed into a color of a middle gray level. Therefore, regardless of whether the user views the improved MVA LCD panel from the front or at an oblique angle, he or she can view similar colors.

In order to achieve the above technology, CHIMEI Corporation has developed an MVA pixel structure (Taiwan Patent Application No. 93132909), as shown in FIG. 2. A protection layer 303 of silicon nitride covers a TFT array substrate 301. Next, transparent electrodes 305 and 307 are disposed on the protection layer 303, so as to divide the entire pixel region into display regions A and B. The transparent electrode 307 is electrically connected to the transparent electrode 309, and the transparent electrode 305 is floated to the transparent electrode 309. In addition, a liquid crystal layer 313 is filled between the TFT array substrate 301 and the opposite substrate 311.

It can be seen from FIG. 2 that in the display region A, since the electrode 307 is at the same potential as the source end 309, and a common electrode 315 on the opposite substrate may be connected to a common voltage, a liquid crystal capacitor 313*a* may be formed in the liquid crystal layer 313. In the display region B, a protection layer capacitor 303*a* may be formed in the protection layer 303 between the electrode 309 and the electrode 305. Similar to the display region A, a liquid crystal capacitor 313*b* is also formed between the electrode 305 and the common electrode 315.

FIG. 3 is an equivalent circuit diagram of the pixel structure in FIG. 2. Referring to FIGS. 2 and 3 together, a drain end of the TFT 321 is electrically connected to the data line 31, and a gate end is electrically connected to the scan line 33. Furthermore, a source end of the TFT 321 is electrically connected to the storage capacitor 323, the liquid crystal capacitor 313*a* in the display region A, the protection layer capacitor 303*a*, and the liquid crystal capacitor 313*b* in the display region B. The voltage of the liquid crystal capacitor 313*a* in the display region A is V1, and the voltages of the protection layer capacitor 303*a* and the liquid crystal capacitor 313*b* in the display region B are V2 and V3 respectively. Considering the voltages of the liquid crystal capacitors in the display region A and in the display region B are different, the light transmittances at each display region may be different. For example, display region A may have a high gray level and display region B may have a low gray level. Mixing the high and low gray levels may produce a middle gray level when viewing the MVA LCD panel from different angles.

BRIEF DESCRIPTION OF THE DRAWINGS

The accompanying drawings, incorporated in and constituting a part of this specification, illustrate one or more implementations consistent with the principles of the invention and, together with the description of the invention, explain such implementations. The drawings are not necessarily to scale, the emphasis instead being placed upon illustrating the principles of the invention.

DETAILED DESCRIPTION

The following description refers to the accompanying drawings. Among the various drawings the same reference numbers may be used to identify the same or similar elements. While the following description provides a thorough understanding of the various aspects of the claimed invention by setting forth specific details such as particular structures, architectures, interfaces, and techniques, such details are provided for purposes of explanation and should not be viewed as limiting. Moreover, those of skill in the art will, in light of the present disclosure, appreciate that various aspects of the invention claimed may be practiced in other examples or implementations that depart from these specific details. At certain junctures in the following disclosure descriptions of well known devices, circuits, and methods have been omitted to avoid clouding the description of the present invention with unnecessary detail.

Figure 1:
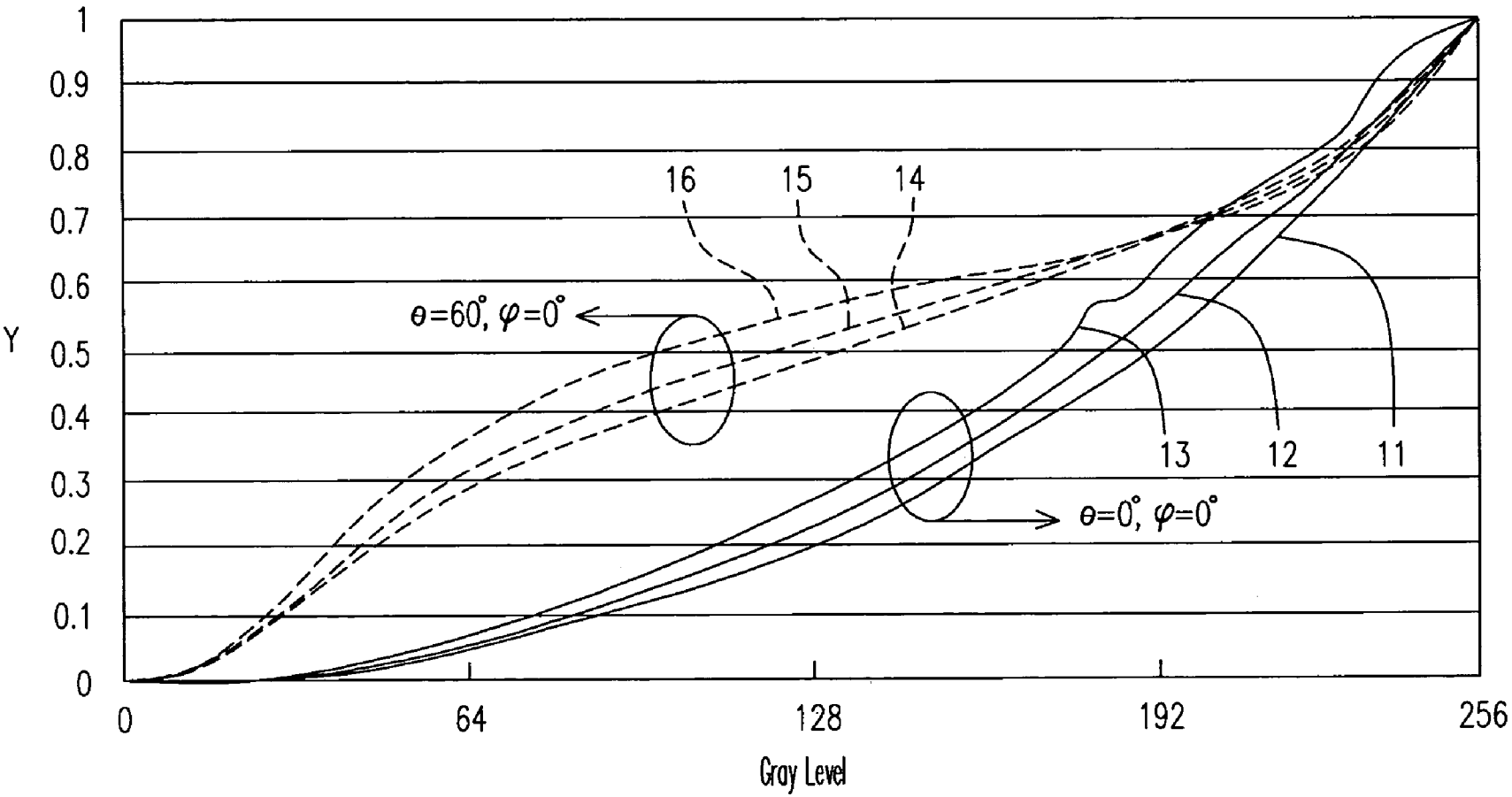
FIG. 1 (PRIOR ART)
FIG. 1 is a characteristic curve diagram of voltage to transmittance of a conventional MVA LCD.
Figure 2:
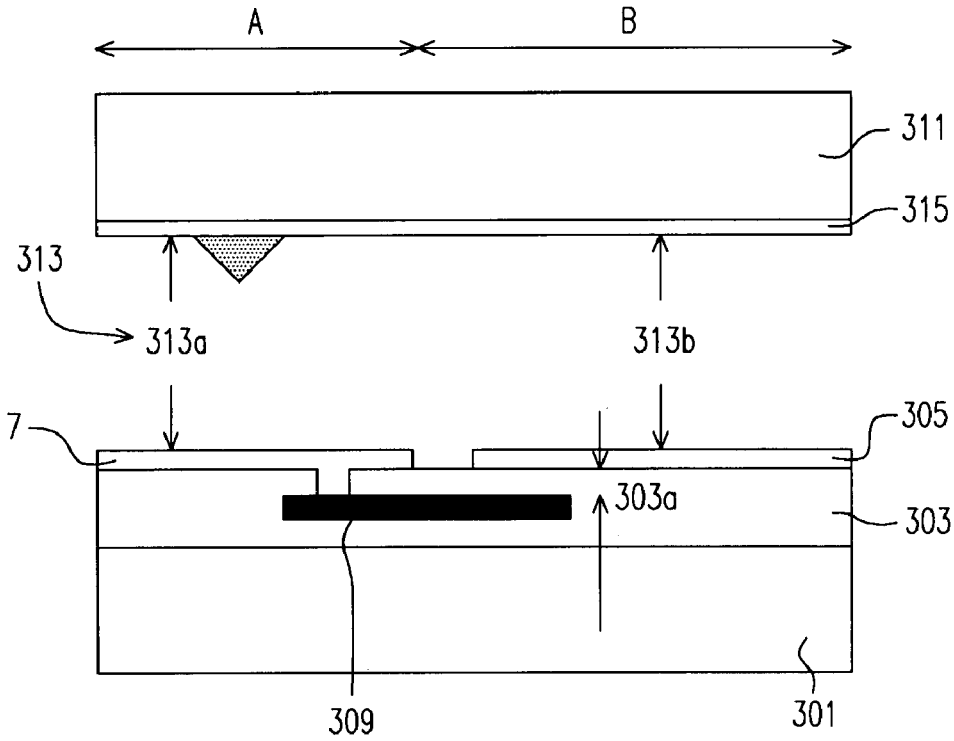
FIG. 2 (PRIOR ART)
FIG. 2 is a side view of a cross-section of a pixel structure in a conventional MVA LCD.
Figure 3:
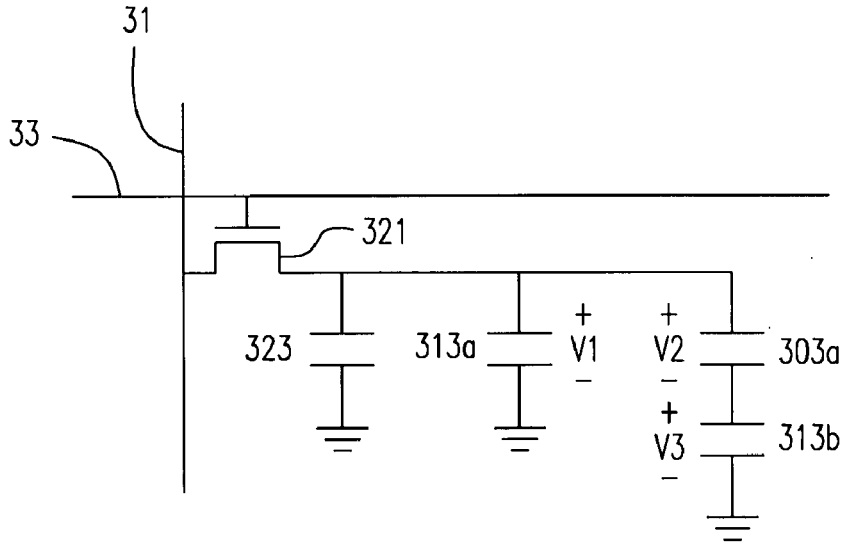
FIG. 3 (PRIOR ART)
FIG. 3 is an equivalent circuit diagram of the pixel structure of FIG. 2.
Figure 4A:
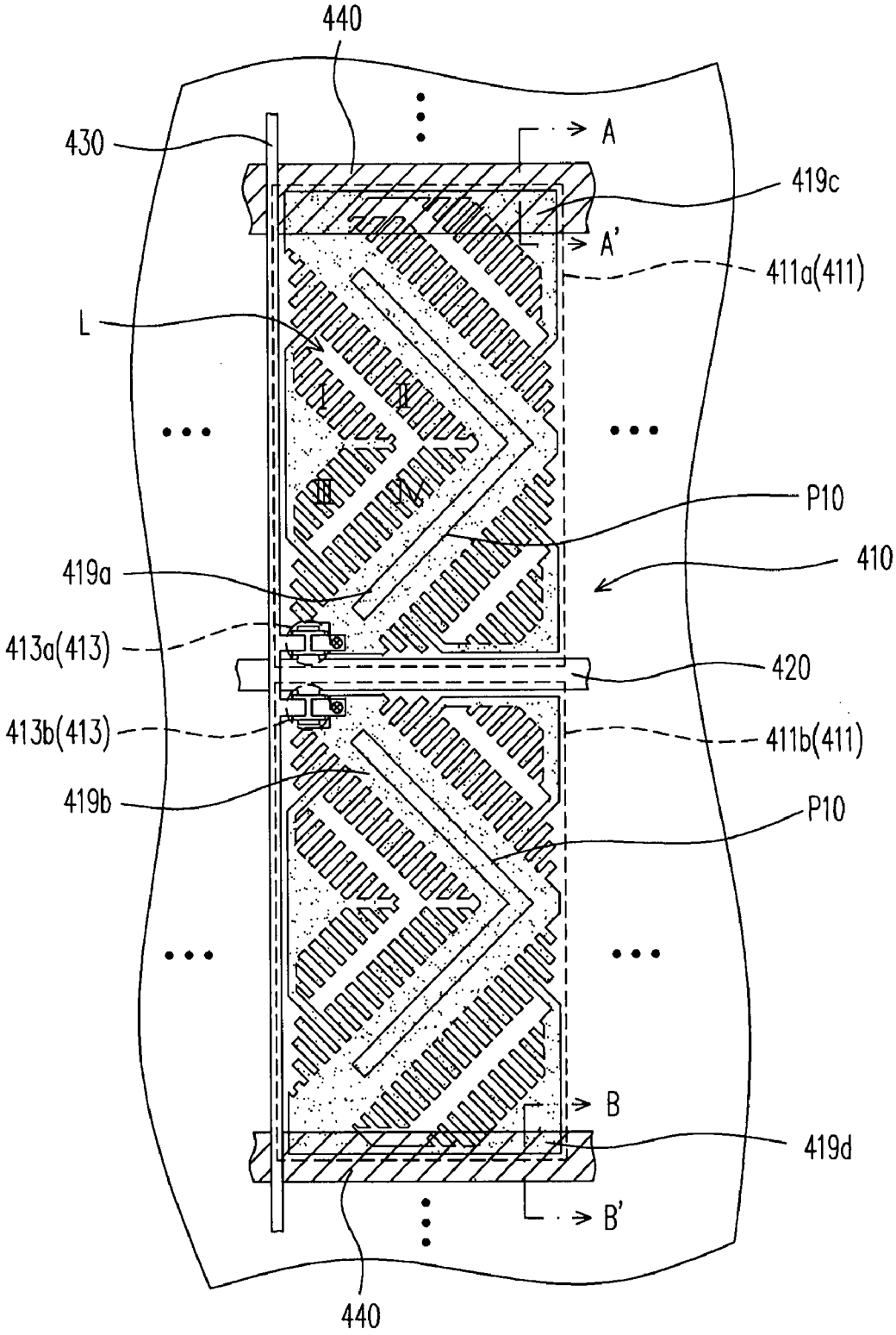
FIG. 4A is a partial top view of an active device array substrate of a liquid crystal display panel according to an embodiment of the present invention.
Figure 4B:
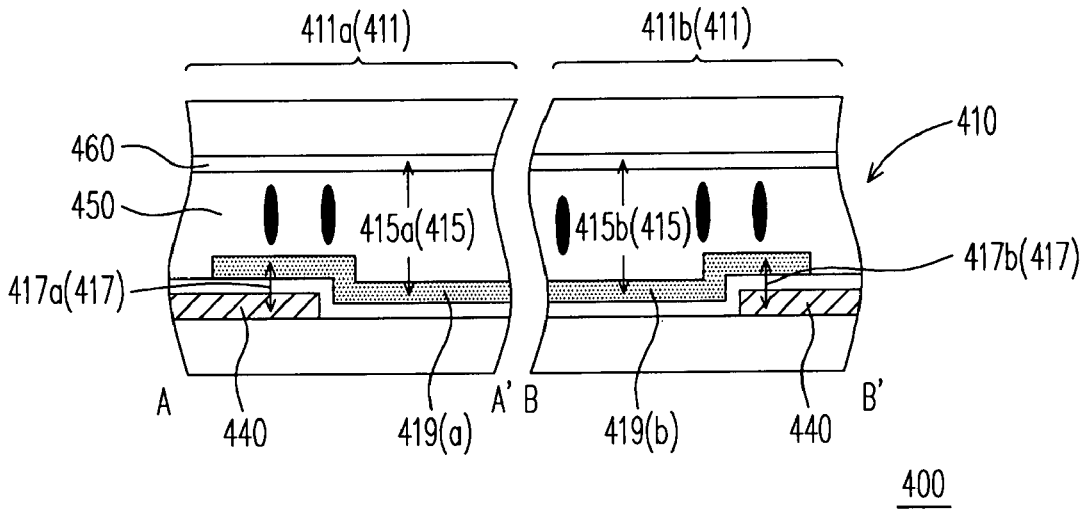
FIG. 4B is a side cross-sectional view of a liquid crystal display panel according to an embodiment of the present invention.

FIG. 4A is a partial top view of an active device array substrate of a liquid crystal display panel according to an embodiment of the present invention. FIG. 4B is a cross-sectional view of a partial structure of the liquid crystal display panel according to an embodiment of the present invention. The cross-sectional view of the active device array substrate in FIG. 4B is taken along the sectional lines A-A' and B-B' in FIG. 4A. Referring to FIGS. 4A and 4B together, the liquid crystal display panel 400 is, for example, but not limited to, an MVA LCD. The liquid crystal display panel 400 may include a plurality of pixel units 410 arranged in an array. Each pixel unit 410 may have a plurality of sub-pixel regions 411 and includes a plurality of active devices 413, a plurality of liquid crystal capacitors 415, and a plurality of storage capacitors 417. One of the active devices 413 may be disposed in one of the sub-pixel regions 411 and electrically connected to a scan line 420 and a data line 430. The liquid crystal capacitors 415 are respectively disposed in the sub-pixel regions 411, and each liquid crystal capacitor 415 is electrically connected to the corresponding active device 413. The storage capacitors 417 are respectively disposed in the sub-pixel regions 411, and each storage capacitor 417 is electrically connected to the corresponding active device 413. In the same pixel unit 410, the ratio of the capacitance of the storage capacitor 417 to that of the liquid crystal capacitor 415 of any sub-pixel region 411 is unequal to the ratio of the capacitance of the storage capacitor 417 to that of the liquid crystal capacitor 415 of any other sub-pixel regions 411.

For the convenience of illustrating the structure of the liquid crystal display panel 400, in this embodiment, each pixel unit 410 only has two sub-pixel regions 411*a* and 411*b*, and only includes two active devices 413*a* and 413*b*, two liquid crystal capacitors 415*a* and 415*b*, and two storage capacitors 417*a* and 417*b* in one embodiment of the invention. Other embodiments of the invention may include more or fewer of any or all of these devices. The active device 413*a* is disposed in the sub-pixel region 411*a*, the active device 413*b* is disposed in the sub-pixel region 411*b*, and both the active device 413*a* and the active device 413*b* are electrically connected to the same scan line 420 and the same data line 430. The liquid crystal capacitor 415*a* is disposed in the sub-pixel region 411*a* and electrically connected to the active device 413*a*, and the liquid crystal capacitor 415*b* is disposed in the sub-pixel region 411*b* and electrically connected to the active device 413*b*. The storage capacitor 417*a* is disposed in the sub-pixel region 411*a* and electrically connected to the active device 413*a*, and the storage capacitor 417*b* is disposed in the sub-pixel region 411*b* and electrically connected to the active device 413*b*. The ratio of the capacitance of the storage capacitor 417*a* to that of the liquid crystal capacitor 415*a* of sub-pixel region 411*a* is unequal to the ratio of the capacitance of the storage capacitor 417*b* to that of the liquid crystal capacitor 415*b* of the sub-pixel region 411*b*.

Each pixel unit 410 further includes two pixel electrodes 419*a* and 419*b* in one embodiment of the invention. More or fewer electrodes may be included in other embodiments of the invention. The pixel electrodes 419*a* and 419*b* are disposed in the sub-pixel region 411*a* and 411*b* respectively. The part of each of the pixel electrodes 419*a*, 419*b* that extends to a storage capacitor line 440 serves as storage capacitor opposite electrode 419*c*, 419*d* respectively. The storage capacitor opposite electrodes 419*c*, 419*d* are respectively coupled with the storage capacitor line 440 to form the storage capacitor 417*a* and the storage capacitor 417*b* respectively. The pixel electrodes 419*a*, 419*b* further have a plurality of main slits L for defining four alignment domains I, II, III, IV respectively. For example, a plurality of protrusions P10 is disposed above the pixel electrodes 419*a*, 419*b*. When the pixel unit 410 is not driven, the liquid crystal molecules in the liquid crystal layer 450 are arranged vertically. When the pixel unit 410 is driven, the liquid crystal molecules in the liquid crystal layer 450 are inclined towards the horizontal direction. Particularly, in one of the specific alignment domains I, II, III, IV, the inclined directions of the liquid crystal molecules are consistent. However, in different alignment domains I, II, III, IV, the inclined direction of the liquid crystal molecules are different from one another. By means of making the liquid crystals inclined towards different directions, the liquid crystal molecules in different alignment domains can compensate for the optical effects generated by a change of viewing angles, such that the liquid crystal display panel 400 has a wider viewing area.

In view of the above, the active devices 413*a*, 413*b* are, for example, TFTs, switching elements with three terminals or another suitable switch element (e.g., diode). The storage capacitor line 440 may be parallel to the scan line 420 and arranged between two adjacent scan lines (e.g., 420). Furthermore, pixel electrode 419*a*, liquid crystal layer 450, and common electrode 460 help form a liquid crystal capacitor 415*a*, and pixel electrode 419*b*, liquid crystal layer 450, and common electrode 460 help form liquid crystal capacitor 415*b*.

Figure 4C:
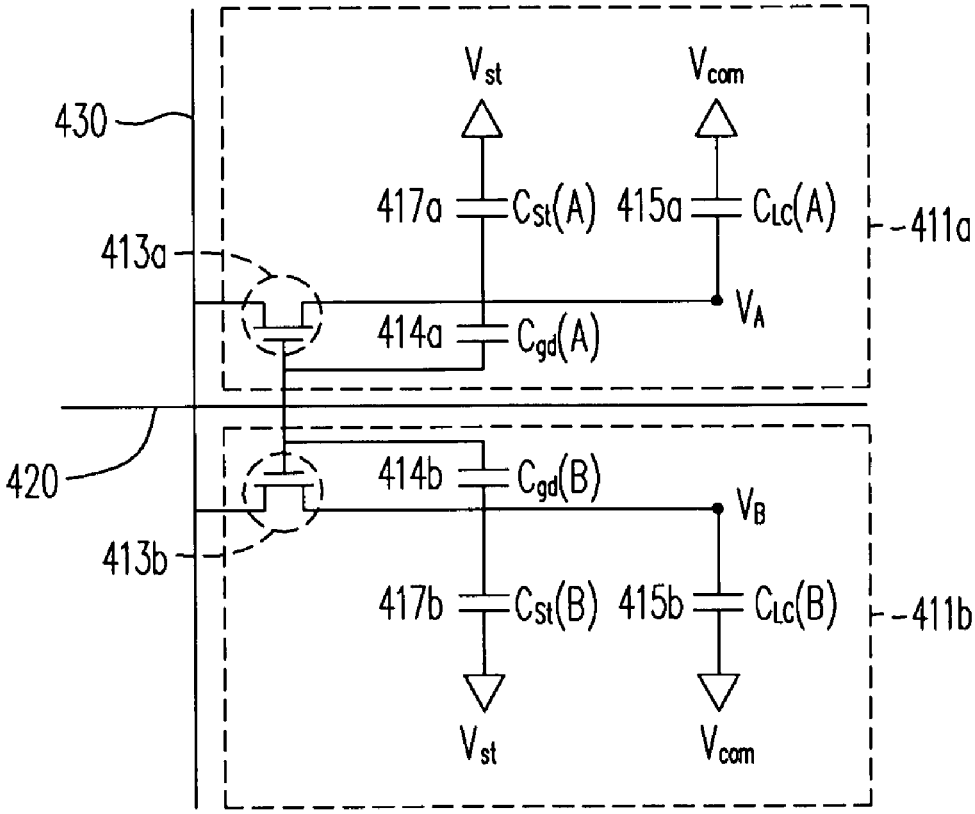
FIG. 4C is an equivalent circuit diagram of a liquid crystal display panel according to an embodiment of the present invention.

FIG. 4C is an equivalent circuit diagram of a liquid crystal display panel according to an embodiment of the present invention. Referring to FIGS. 4A and 4C, in each pixel unit 410 the active device 413*a* has a parasitic capacitor 414*a* of a capacitance $C_{gd}$(A), and the active device 413*b* has a parasitic capacitor 414*b* of a capacitance $C_{gd}$(B). The capacitance $C_{gd}$(A) may be equal to or different from the capacitance $C_{gd}$(B).

It should be mentioned that in the liquid crystal display panel 400 of this embodiment, each pixel unit 410 includes two sub-pixel regions 411*a* and 411*b* and the ratio of the storage capacitance $C_{St}$(A) to the liquid crystal capacitance $C_{LC}$(A) of the sub-pixel region 411*a* is unequal to the ratio of the storage capacitance $C_{St}$(B) to the liquid crystal capacitance $C_{LC}$(B) of the sub-pixel region 411*b*, i.e., $C_{St}(A)/C_{LC}(A) \neq C_{St}(B)/C_{LC}(B)$. Other embodiments of the invention may include more or fewer subpixel regions. If the characteristic that the ratio of the capacitance of the sub-pixel region 411*a* is unequal to that of the sub-pixel region 411*b* is utilized together with an appropriate driving method, the voltage $V_A$ on the pixel electrode 419*a* can be adjusted to be different from the voltage $V_B$ on the pixel electrode 419*b*. If the pixel electrode voltage $V_A$ and the pixel electrode voltage $V_B$ are different, the voltage difference at both ends of the liquid crystal capacitor 415*a* may be different from that at both ends of the liquid crystal capacitor 415*b*. Therefore, the liquid crystal molecules in the sub-pixel region 411*a* and that in the sub-pixel region 411*b* may be inclined to different extents. In other words, the liquid crystal molecules in a same pixel unit 410 may have, for example, eight inclining angles based on the number of different alignment domains. Consequently, the light transmittances of the sub-pixel region 411*a* and the sub-pixel region 411*b* may be different (e.g., 411*a* has a high gray level and 411*b* has a low gray level), and the liquid crystal molecules in two sub-pixel regions 411*a*, 411*b* can compensate the optical effects (e.g., form a middle gray level), thereby eliminating or reducing the color shift phenomenon of the liquid crystal display panel 400.

In order to achieve $C_{St}(A)/C_{LC}(A) \neq C_{St}(B)/C_{LC}(B)$, in one embodiment, the storage capacitance $C_{St}(A)$ of the storage capacitor 417*a* is different from the storage capacitance $C_{St}(B)$ of the storage capacitor 417*b*. The method of achieving $C_{St}(A)/C_{LC}(A) \neq C_{St}(B)/C_{LC}(B)$, however, is not limited to the above method. In another embodiment, the liquid crystal capacitance $C_{LC}(A)$ of the liquid crystal capacitor 415*a* may be unequal to the liquid crystal capacitance $C_{LC}(B)$ of the liquid crystal capacitor 415*b*, so as to achieve $C_{St}(A)/C_{LC}(A) \neq C_{St}(B)/C_{LC}(B)$. There are various methods for making the liquid crystal capacitance $C_{LC}(A)$ unequal to the liquid crystal capacitance $C_{LC}(B)$. For example, the layout of the mask may be changed to make the pixel electrode 419*a* and the pixel electrode 419*b* have different areas. Furthermore, an insulating layer (not shown) may be formed below the pixel electrode 419*a* or the pixel electrode 419*b*, such that the sub-pixel region 411*a* and the sub-pixel region 411*b* have different cell gaps. In other embodiments, $C_{St}(A)/C_{LC}(A) \neq C_{St}(B)/C_{LC}(B)$ may be obtained by having $C_{St}(A) \neq C_{St}(B)$ and $C_{LC}(A) \neq C_{LC}(B)$. Hereinafter, the driving method for the liquid crystal display panel 400 is described.

Figure 4D:
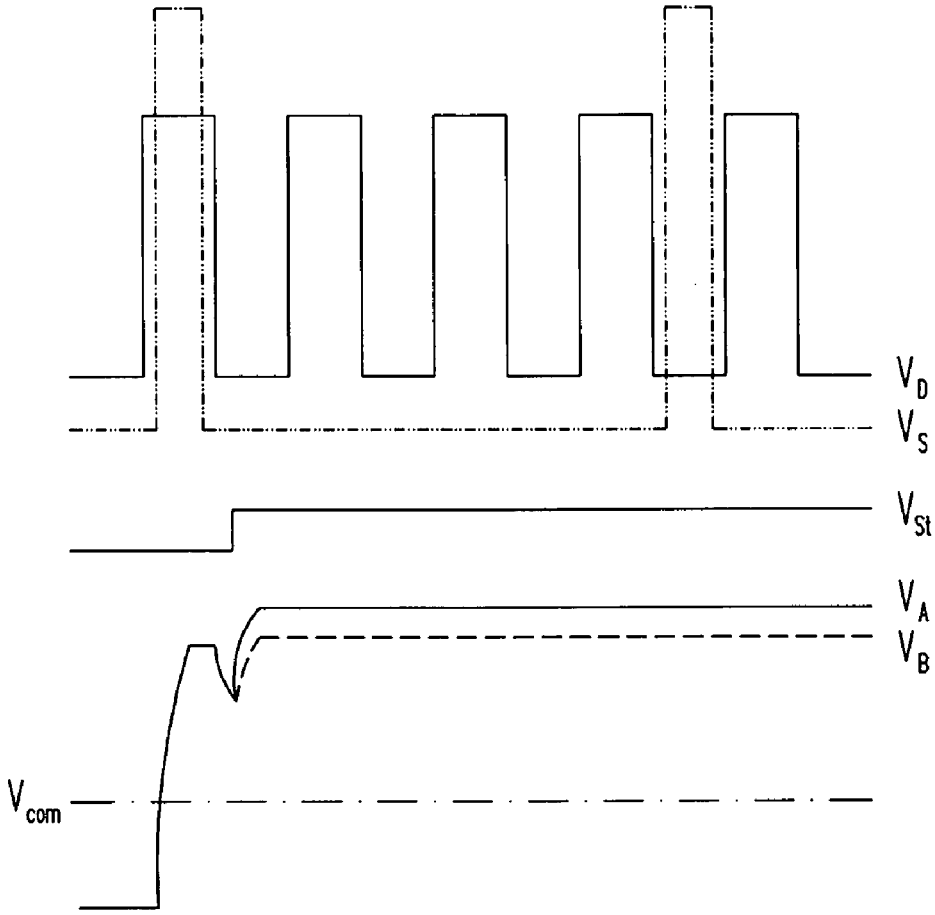
FIG. 4D is a view of a drive waveform and relation curve in an embodiment of the invention.

FIG. 4D is a schematic view of a drive waveform in a certain time sequence of the liquid crystal display panel in FIG. 4C. Referring to FIGS. 4C and 4D, in the driving method, firstly, a scan signal $V_S$ is applied to the scan line 420. Then, a data signal $V_D$ is applied to the data line 430. After that, a compensation signal $V_{St}$ remains applied to the storage capacitor line 440. Furthermore, a common voltage $V_{com}$ is applied to the common electrode 460, and the high level voltage of the data signal $V_D$ is greater than the value of the common voltage $V_{com}$.

FIG. 4D further shows a relation curve between the pixel electrode voltage $V_A$ of the pixel electrode 419*a* and the pixel electrode voltage $V_B$ of the pixel electrode 419*b*. The relation curve is shown below the drive waveform and does not share, for example, a Y axis (V) with the drive waveform plot. It can be seen from FIG. 4D that when the scan signal $V_S$ is switched from a high level to a low level, the compensation signal $V_{St}$ is switched to a high level. Specifically, when the scan signal $V_S$ is switched from the high level to the low level, the pixel electrode voltage $V_A$ and the pixel electrode voltage $V_B$ are slightly dropped due to a feed-through effect of the parasitic capacitor 414*a* and the parasitic capacitor 414*b*. However, after the compensation signal $V_{St}$ is switched from a low level to a high level, the pixel electrode voltage $V_A$ and the pixel electrode voltage $V_B$ rises due to the feed-through effects.

Also, since $C_{St}(A)/C_{LC}(A) \neq C_{St}(B)/C_{LC}(B)$, the amounts of rising respectively for the pixel electrode voltage $V_A$ and the pixel electrode voltage $V_B$ due to the feed-through effect caused by the variation of the compensation signal $V_{St}$ are different, and the magnitude of the rising voltage $\Delta V$ (i.e., "feedthrough voltage") for either $\Delta V_A$ or $\Delta V_B$ is expressed by the following equation:

$$\Delta V = \frac{C_{gd}(V_{StH} - V_{StL})}{(C_{LC} + C_{St} + C_{gd})}, \qquad \text{Equation 1}$$

where $V_{StH}$ is a high level voltage of the compensation signal, $V_{StL}$ is a low level voltage of the compensation signal. It can be seen from Equation 1 that as the storage capacitance $C_{St}(A)$ and the storage capacitance $C_{St}(B)$ are different, the extent of rising (e.g., $\Delta V_A$, $\Delta V_B$) of the pixel electrode voltage $V_A$ and the pixel electrode voltage $V_B$ respectively in different sub-pixel regions is different. Therefore, the voltage difference at two ends of the liquid crystal capacitor 415*a* is different from that at two ends of the liquid crystal capacitor 415*b*, such that the liquid crystal molecules in the sub-pixel region 411*a* and the sub-pixel region 411*b* are inclined to different extents. As a result, the light transmittance of the sub-pixel region 411*a* is different from that of the sub-pixel region 411*b*. If the above driving method is used to adjust the pixel electrode voltage $V_A$ and the pixel electrode voltage $V_B$ to change the light transmittances of the sub-pixel region 411*a* and the sub-pixel region 411*b*, the color shift phenomenon of the liquid crystal display panel 400 can be eliminated or reduced.

It should be noted that the above driving method is suitable for the circumstance when the value of the high level voltage of the data signal $V_D$ is greater than the value of the common voltage $V_{com}$. However, if the value of the high level voltage of the data signal $V_D$ is smaller than the common voltage $V_{com}$, the switching of the compensation signal $V_{St}$ may be different, in one embodiment of the invention, from that described above.

Figure 4E:
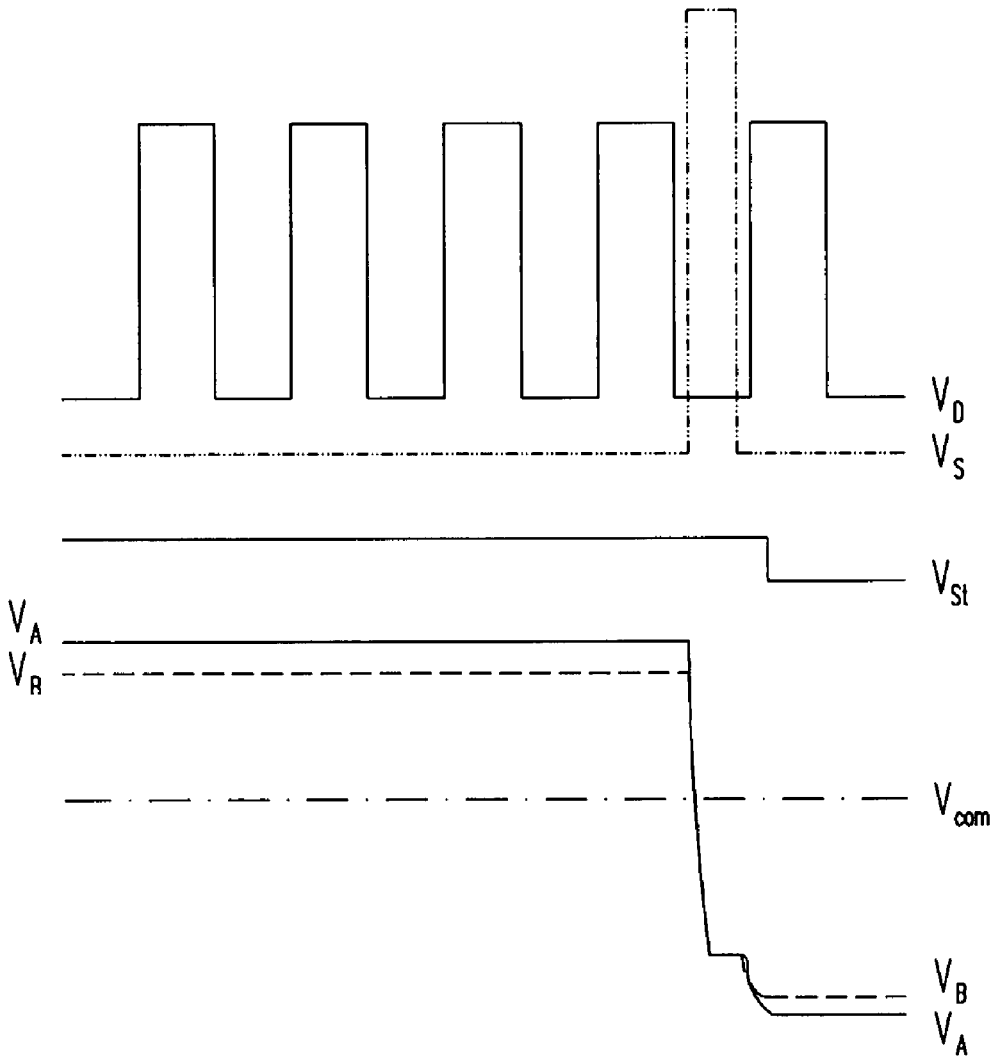
FIG. 4E is a view of a drive waveform and relation curve in an embodiment of the invention.

For example, FIG. 4E is a schematic view of a drive waveform of the liquid crystal display panel in FIG. 4C under another circumstance. When the value of the high level voltage of the data signal $V_D$ is smaller than the value of the common voltage $V_{com}$ and after the scan signal $V_S$ is switched from the high level to the low level, the pixel electrode voltage $V_A$ and the pixel electrode voltage $V_B$ are dropped due to the feed-through effect of the parasitic capacitor 414*a* and the parasitic capacitor 414*b*. Then, the compensation signal $V_{St}$ is switched to the low level, and the pixel electrode voltage $V_A$ and the pixel electrode voltage $V_B$ are dropped again, instead of rising. The dropping extents of the pixel electrode voltage $V_A$ and the pixel electrode voltage $V_B$ are different, so that the light transmittance of the sub-pixel region 411*a* is different from that of the sub-pixel region 411*b*, which further eliminates the color shift phenomenon of the liquid crystal display panel 400.

Figure 4F:
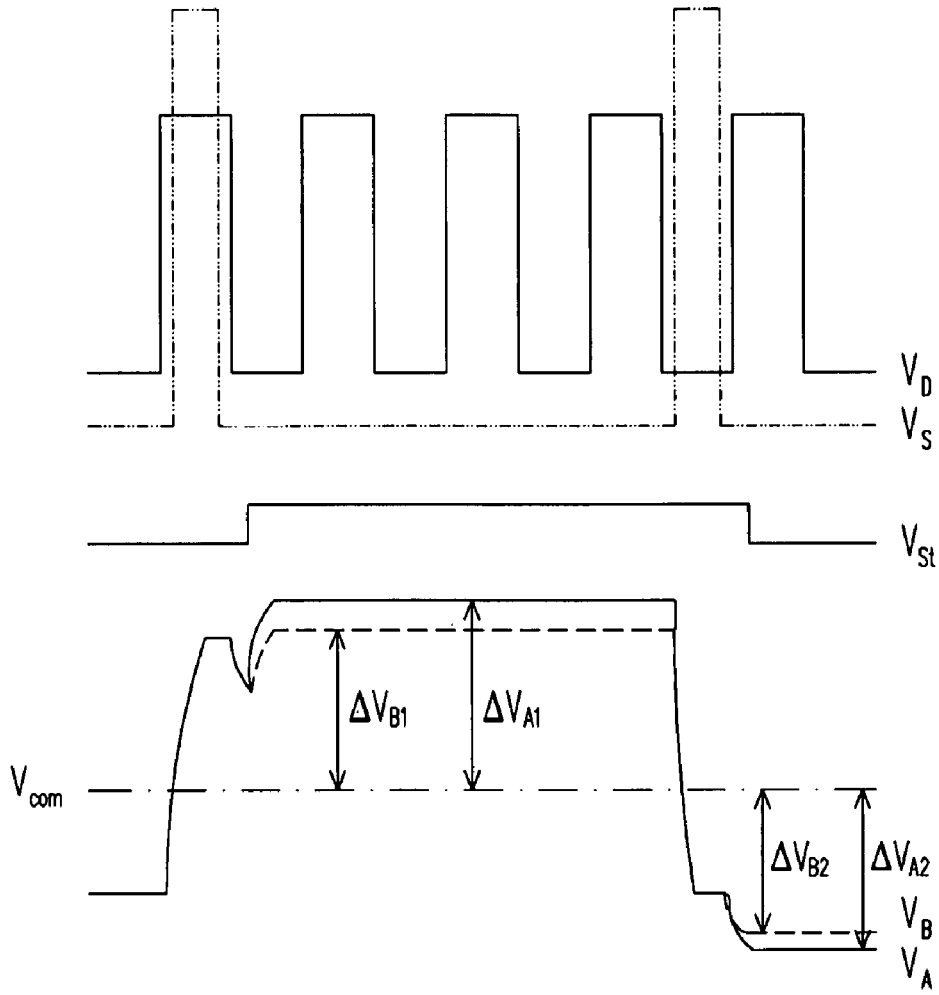
FIG. 4F is a view of a drive waveform and relation curve in an embodiment of the invention.

However, when taking the frame with a positive polarity (e.g., FIG. 4D) and the frame with a negative polarity (e.g., FIG. 4E) into account, if the feedthrough voltage is different in different sub-pixel regions due to the parasitic capacitor (i.e., parasitic capacitance), the sub-pixel regions cannot have the same common voltage $V_{com}$. In each sub-pixel region, the feedthrough voltage equation caused by the parasitic capacitor is expressed by Equation 1. In one embodiment of the present invention, the capacitance $C_{gd}(A)$ and the capacitance $C_{gd}(B)$ may be adjusted to be different according to the above Equation 1, such that the pixel electrode voltage $V_A$ and the pixel electrode voltage $V_B$ respectively located in different sub-pixel regions have the same feedthrough voltage regardless of whether the frame has a positive polarity (e.g., FIG. 4D) or a negative polarity (e.g., FIG. 4E). That is, $\Delta V_{A1}$ (positive frame) is equal to $\Delta V_{A2}$ (negative frame), and $\Delta V_{B1}$ (positive frame) is equal to $\Delta V_{B2}$ (negative frame, as shown in FIG. 4F), thereby making each of the sub-pixel regions have the same common voltage $V_{com}$.

Figure 4G:
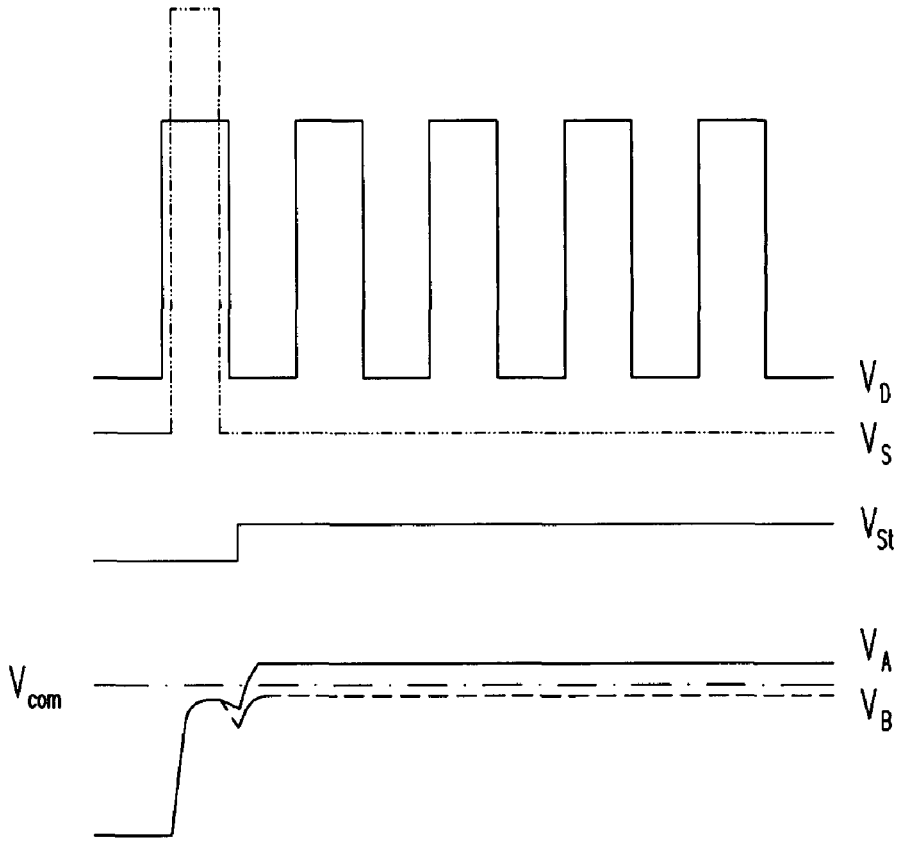
FIG. 4G is a view of a drive waveform and relation curve in an embodiment of the invention.

If a frame with a low gray level is displayed in the liquid crystal display, the frame with a low gray level must be ensured to have a minimum dark-state brightness, so as to achieve a frame with a high contrast. FIG. 4G is a schematic view of a drive waveform of the liquid crystal display panel in FIG. 4C according to another embodiment of the present invention. In a frame with a low gray level, the data signal $V_D$ with a low gray level of a positive polarity can be adjusted to be smaller than the value of the common voltage $V_{com}$. As the compensation signal $V_{St}$ is switched from a low level to a high level, the pixel electrode voltage $V_A$ and the pixel electrode voltage $V_B$ can be increased such that the pixel electrode voltage $V_A$ is greater than the common voltage $V_{com}$, and the pixel electrode voltage $V_B$ is still smaller than the common voltage $V_{com}$. Therefore, the average visual effect may be equal to the original low gray level display of a positive polarity and thereby achieve a low color shift effect.

Figure 4H:
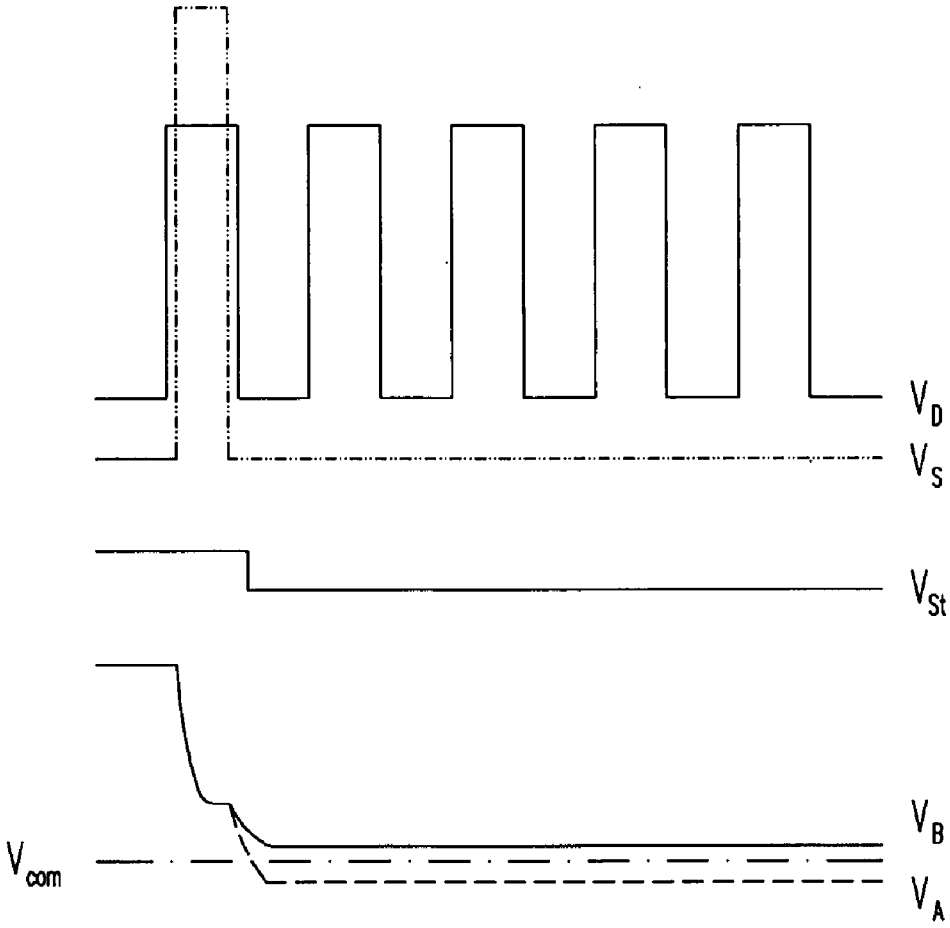
FIG. 4H is a view of a drive waveform and relation curve in an embodiment of the invention.

FIG. 4H is a schematic view of a drive waveform of the liquid crystal display panel in FIG. 4C according to still another embodiment of the present invention. In the low gray level display of a negative polarity, the low gray level data signal $V_D$ of a negative polarity can be adjusted to be greater than the value of the common voltage $V_{com}$. The compensation signal $V_{St}$ may be switched from a high level to a low level and the pixel electrode voltage $V_A$ and the pixel electrode voltage $V_B$ may be dropped as a result, the pixel electrode voltage $V_A$ may be lower than the common voltage $V_{com}$ and the pixel electrode voltage $V_B$ may still be higher than the common voltage $V_{com}$. Therefore, the average visual effect is equal to the original low gray level display of a negative polarity, thereby achieving a low color shift effect.

Figure 5:
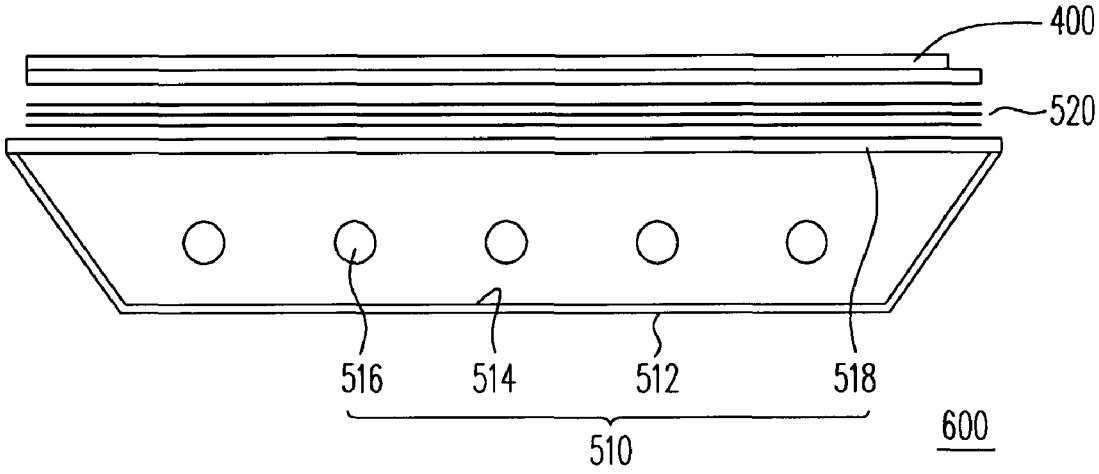
FIG. 5 is a top view of a LCD according to an embodiment of the present invention.

The above liquid crystal display panel 400 can be used to assemble a liquid crystal display. FIG. 5 is a schematic structural view of an LCD according to an embodiment of the present invention. Referring to FIG. 5, the liquid crystal display 600 may include a liquid crystal display panel 400, a backlight module 510, and an optical film 520. The backlight module 510 may be a cold cathode fluorescence lamp (CCFL) backlight module, and may include a back frame 512, a reflector 514, a plurality of cold cathode fluorescence lamps (CCFLs) 516, and a diffuser 518. The diffuser 518 may be disposed above the back frame 512, the CCFLs 516 may be disposed between the diffuser 518 and the back frame 512, and the reflector 514 may be disposed between the CCFLs 516 and the back frame 512. Similarly, the liquid crystal display panel 400 may be disposed above the backlight module 510. The optical film 520 may be disposed between the liquid crystal display panel 400 and the backlight module 510. In this embodiment, the backlight module 510 is a CCFL backlight module, but in another embodiment, the backlight module 510 can also be a light emitting diode (LED) backlight module or another suitable backlight source.

Since the liquid crystal display 600 is assembled using the liquid crystal display panel 400, the liquid crystal display 600 not only has a relatively large viewing angle, but the color shift phenomenon can also be eliminated.

In one embodiment of the invention, the liquid crystal display panel may employ a row inversion driving method. In other words, in the same frame time data signals applied to the pixel units 410 in the same row have the same polarity and data signals applied to the pixel units 410 in two adjacent rows have opposite polarities. In a liquid crystal display panel 400 adopting a driving method of row inversion, the storage capacitor line 440 may be parallel to the scan line 420 and arranged between two adjacent scan lines 420 in one embodiment of the invention. In other words, pixel units 410 sharing the same common scan line 420 may also share the same common storage capacitor line(s) 440. Particularly, any two adjacent pixel units 410 in the same row may share the same common storage capacitor line(s) 440. Thus, as for two adjacent pixel units 410, the compensation signals $V_{St}$ may have the same value, and the writing voltage of the two pixel units 410 may have the same polarity.

Figure 6:
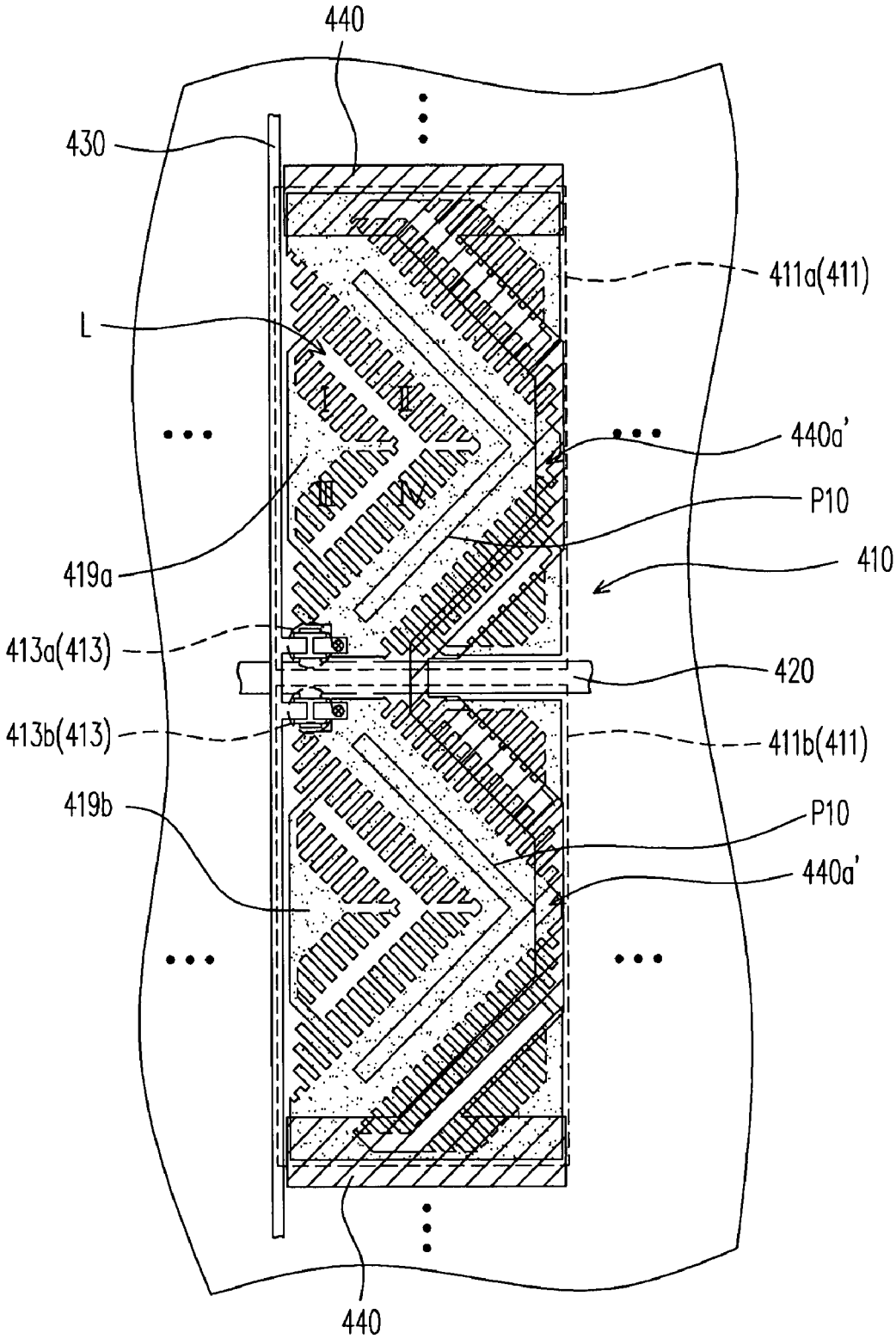
FIG. 6 is a partial top view of an active device array substrate according to an embodiment of the present invention.

The storage capacitor line 440 is not limited to the shape as shown in FIG. 4B. For example, in another embodiment of the invention (FIG. 6), the driving method of the liquid crystal display panel may also be the row inversion mode. The storage capacitor line 440 may extend on the liquid crystal display panel in a direction substantially the same as that of the data line 430. Also, the storage capacitor line 440 may further have a plurality of extension lines 440*a*' disposed along the main slit L of the pixel electrode 410. Since the area above the main slit L is a "no effect" area and the extension line 440*a*' is made of an opaque material, the aperture ratio of the pixel unit 410 may not be reduced after the extension line 440*a*' is disposed along the main slit L of the pixel electrodes 419*a*, 419*b*.

Also, the driving method is not limited to the row inversion mode, but can also be, for example but without limitation, column inversion, pixel inversion, dot inversion mode or "many dot" inversion mode. Specifically, the liquid crystal display panel of FIG. 6 can adopt the driving method of dot inversion. In this embodiment of the invention, the compensation signals $V_{St}$ can be different since the pixel units 410 in any two adjacent columns use different storage capacitor lines 440. Therefore, the writing voltages of two pixel units 410 can have opposite polarities.

In addition, the liquid crystal display panel 400 may be a normally dark display apparatus. That is, when no voltage is applied to the liquid crystal capacitor 415*a* and the liquid crystal capacitor 415*b*, the display is normally dark. When the pixel unit 410 is lightened abnormally, one can weld the pixel electrode 419*a* (or the pixel electrode 419*b*) and the storage capacitor line 440 together by means of, for example, a laser. Considering the characteristic that the average compensation signal $V_{St}$ of the storage capacitor line 440 equals the common voltage $V_{com}$, coupling the storage capacitor or line to the pixel electrode 419*a*, 419*b* may make the lightened pixel unit 410 become a dark dot so as to reduce the sensation of human eyes to dead spots and thereby enhance the display quality.

The process for manufacturing the aforementioned liquid crystal display panel and the liquid crystal display of the present invention is compatible with the current manufacturing processes in this field, without requiring additional manufacturing equipments. Also, the driving method of the present invention is not limited to be applied to the MVA LCD, but can also be applied to other kinds of liquid crystal displays, for example, twisted nematic (TN) LCD, in-plane switching (IPS) LCD, optically compensated bend (OCB) LCD, etc.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A liquid crystal display device comprising:

a liquid crystal layer;

a plurality of common electrodes;

a pixel having at least a first sub-pixel region and a second sub-pixel region;

a first active device, in the first sub-pixel region, coupled to a first pixel electrode, a scan line, a data line, and a first storage capacitor opposite electrode;

one of the common electrodes, the first pixel electrode, and a portion of the liquid crystal layer form a first liquid crystal capacitor having a first capacitance;

a first storage capacitor line and the first storage capacitor opposite electrode forming a first storage capacitor having a second capacitance;

a second active device, in the second sub-pixel region, coupled to a second pixel electrode, the scan line, the data line, and a second storage capacitor opposite electrode;

the second pixel electrode, one of the common electrodes and a portion of the liquid crystal layer form a second liquid crystal capacitor having a third capacitance; and a second storage capacitor line and the second storage capacitor opposite electrode forming a second storage capacitor having a fourth capacitance;

wherein a first ratio of the first capacitance to the second capacitance is unequal to a second ratio of the third capacitance to fourth capacitance and the device is configured to:

apply a scan signal to the scan line and a data signal to the data line;

apply a compensation signal to the first storage capacitor and the second storage capacitor;

switch the compensation signal to a high level based on the scan signal switching to a low level and to a low level based on the scan signal switching to a low level;

switch the scan signal to a low level and apply the data signal at a low gray level with a positive polarity; the voltage of the data signal being less than a common voltage of a liquid crystal display panel; and switch the scan signal to a low level and apply the data signal at a low gray level with a negative polarity, the voltage of the data signal being greater than the common voltage;

wherein the first active device has a first parasitic capacitance and the second active device has second parasitic capacitance, the first parasitic capacitance unequal to the second parasitic capacitance;

wherein the first and second sub-pixel regions respectively include equivalent feedthrough voltages and equivalent common voltages.

2. The device of claim 1, further comprising a third storage capacitor line to couple the first storage capacitor line to the second storage capacitor line, the third storage capacitor line including a first portion formed substantially parallel to a first data line.

3. The device of claim 1, wherein the second capacitance is unequal to the fourth capacitance.

4. The device of claim 1, wherein the first capacitance is unequal to the third capacitance.

5. The device of claim 1, further comprising a third storage capacitor line to couple the first storage capacitor line to the second storage capacitor line, the third storage capacitor line including a first portion and a second portion; wherein the first pixel electrode includes a first plurality of slits, the second pixel electrode includes a second plurality of slits, and the first portion is formed along the first plurality of slits and the second portion is formed along the second plurality of slits.

6. The device of claim 1, wherein the first storage capacitor opposite electrode is coupled to the first pixel electrode.

7. The device of claim 1, wherein the first storage capacitor opposite electrode extends from the first pixel electrode.

8. The device of claim 1, further comprising:

a first storage capacitor electrode coupled to the first storage capacitor line to form the first storage capacitor;

wherein the device is configured to apply the compensation signal to the first storage capacitor line.

9. The device of claim 1, wherein the device is configured to be driven using a column inversion mode.

10. The device of claim 1, wherein the device is configured to be driven using a mode chosen from the group consisting of row inversion, pixel inversion, and dot inversion.

11. The device of claim 1, wherein the data signal has a first frequency and the compensation signal has the first frequency.

12. A liquid crystal display device, having a plurality of pixel units arranged in an array, wherein each pixel unit has a plurality of sub-pixel regions, and each pixel unit comprises:

a plurality of active devices, each of the plurality of active devices being formed in one of the sub-pixel regions and to electrically connect to a scan line and a data line;

a plurality of liquid crystal capacitors, each of the plurality of liquid crystal capacitors formed in one of the sub-pixel regions and to electrically connect to one of the plurality of active devices; and a plurality of storage capacitors, each of the plurality of storage capacitors formed in one of the sub-pixel regions and to electrically connect to one of the plurality of active devices;

wherein in a same pixel unit, a ratio of the capacitance of the storage capacitor to that of the liquid crystal capacitor of any sub-pixel region is unequal to a ratio of the capacitance of the storage capacitor to that of the liquid crystal capacitor of any other sub-pixel region;

wherein the device is configured to:

apply a compensation signal to a first of the storage capacitors and to a second of the storage capacitors;

switch the compensation signal to a high level based on a scan signal switching to a low level and to a low level based on the scan signal switching to a low level;

switch the scan signal to a low level and apply a data signal at a low gray level with a positive polarity; the voltage of the data signal being less than a common voltage of a liquid crystal display panel; and switch the scan signal to a low level and apply the data signal at a low gray level with a negative polarity, the voltage of the data signal being greater than the common voltage;

wherein the active devices in the same pixel unit are to have different parasitic capacitances;

wherein the sub-pixel regions respectively include equivalent feedthrough voltages and equivalent common voltages.

13. The liquid crystal display device as claimed in claim 12, wherein the capacitances of the storage capacitors are to be different.

14. The liquid crystal display device as claimed in claim 12, wherein each of the pixel units further comprises a plurality of storage capacitor opposite electrodes respectively formed in the sub-pixel regions and respectively coupled to a plurality of storage capacitor lines to form the storage capacitors; and further wherein the pixel electrodes of each pixel unit have a plurality of slits and each storage capacitor line is formed along the corresponding slit.

15. The device of claim 12, wherein the device is configured to be driven using a column inversion mode.

16. The device of claim 12, wherein the device is configured to be driven using a mode chosen from the group consisting of row inversion, pixel inversion, and dot inversion.

17. The device of claim 12, wherein the data signal and the compensation signal have the same frequency.

* * * * *